US011837205B2

(12) United States Patent
Maezawa

(10) Patent No.: US 11,837,205 B2
(45) Date of Patent: Dec. 5, 2023

(54) MUSICAL ANALYSIS METHOD AND MUSIC ANALYSIS DEVICE

(71) Applicant: Yamaha Corporation, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 306 days.

(21) Appl. No.: 17/480,004

(22) Filed: Sep. 20, 2021

(65) Prior Publication Data

US 2022/0005443 A1 Jan. 6, 2022

Related U.S. Application Data

(63) Continuation of application No. PCT/JP2020/012456, filed on Mar. 19, 2020.

(30) Foreign Application Priority Data

Mar. 22, 2019 (JP) ..... 2019-055117

(51) Int. Cl.
*G10H 1/00* (2006.01)

(52) U.S. Cl.
CPC ..... *G10H 1/0008* (2013.01); *G10H 2210/031* (2013.01); *G10H 2210/131* (2013.01)

(58) Field of Classification Search
CPC ..... G11B 2020/10546; G06F 3/165; G06F 16/68; G06F 16/683; G06F 16/433
USPC ..... 700/94
See application file for complete search history.

(56) References Cited

U.S. PATENT DOCUMENTS 11,024,276 B1 * 6/2021 Dabby ..... G10H 1/0025
11,334,804 B2 * 5/2022 Apokatanidis ..... G06N 20/00
2002/0194984 A1 * 12/2002 Pachet ..... G10H 1/0025 84/609
2008/0236371 A1 * 10/2008 Eronen ..... G10H 1/40 84/622
2009/0287323 A1 * 11/2009 Kobayashi ..... G10H 1/0008 84/453

(Continued)

FOREIGN PATENT DOCUMENTS

JP 2004233965 A 8/2004
JP 2007156434 A 6/2007

(Continued)

OTHER PUBLICATIONS

Notice of Reasons for Refusal in the corresponding Japanese Patent Application No. 2019-055117, dated Dec. 23, 2022.

(Continued)

*Primary Examiner* — Alexander Krzystan
(74) *Attorney, Agent, or Firm* — Global IP Counselors, LLP

(57) ABSTRACT

A music analysis method realized by a computer includes calculating an evaluation index of each of a plurality of structure candidates formed of N analysis points selected in different combinations from K analysis points in an audio signal of a musical piece, and selecting one of the plurality of structure candidates as a boundary of a structure section of the musical piece in accordance with the evaluation index of each of the plurality of structure candidates. N is a natural number greater than or equal to 2 and less than K, and K is a natural number greater than or equal to 2.

15 Claims, 5 Drawing Sheets

(56) References Cited

U.S. PATENT DOCUMENTS

| | | | | |
|---|---|---|---|---|
| 2014/0307878 | A1* | 10/2014 | Osborne | G10H 1/0008 381/56 |
| 2015/0094835 | A1* | 4/2015 | Eronen | G10H 1/0008 700/94 |
| 2016/0379082 | A1* | 12/2016 | Rodriguez | G06F 3/04886 382/100 |
| 2017/0092247 | A1* | 3/2017 | Silverstein | G10H 1/0025 |
| 2020/0152162 | A1 | 5/2020 | Maezawa | |
| 2022/0005443 | A1* | 1/2022 | Maezawa | G10H 1/0008 |

FOREIGN PATENT DOCUMENTS

| | | | |
|---|---|---|---|
| JP | 2017090848 | A | 5/2017 |
| JP | 2019020631 | A | 2/2019 |

OTHER PUBLICATIONS

International Search Report in PCT/JP2020/012456, dated Jun. 23, 2020.

Ullrich, K. et al., Boundary Detection in Music Structure Analysis using Convolutional Neural Networks, Proc. 15th International Society for Music Information Retrieval Conference (ISMIR 2014), Oct. 2014.

* cited by examiner

MUSICAL ANALYSIS METHOD AND MUSIC ANALYSIS DEVICE

CROSS-REFERENCE TO RELATED APPLICATIONS

This application is a continuation application of International Application No. PCT/JP2020/012456, filed on Mar. 19, 2020, which claims priority to Japanese Patent Application No. 2019-055117 filed in Japan on Mar. 22, 2019. The entire disclosures of International Application No. PCT/JP2020/012456 and Japanese Patent Application No. 2019-055117 are hereby incorporated herein by reference.

BACKGROUND

Technical Field

This disclosure relates to a technology for analyzing the structure of a musical piece.

Background Information

Technologies for estimating the structure of a musical piece by analyzing audio signals that represent the sounds of the musical piece have been proposed in the prior art. For example, Ulrich, J. Schluter, and T. Grill, "Boundary Detection in Music Structure Analysis using Convolutional Neural Networks," ISMIR, 2014 discloses a technology for inputting a feature amount extracted from an audio signal in order to estimate a boundary of a structure section (such as the A-section or the chorus) of a musical piece. Japanese Laid-Open Patent Publication No. 2017-90848 discloses a technology for using the feature amount of chords and timbres extracted from an audio signal to estimate the structure sections of the musical piece. In addition, Japanese Laid-Open Patent Publication No. 2019-20631 discloses a technology for analyzing an audio signal and thereby estimate beat points in a musical piece.

SUMMARY

However, with the technologies of Ulrich, J. Schluter, and T. Grill, "Boundary Detection in Music Structure Analysis using Convolutional Neural Networks," ISMIR, 2014 and Japanese Laid-Open Patent Publication No. 2017-90848, there are cases in which the analytical results do not match within the musical piece in regard to the duration of structure sections. For example, there is the possibility that a structure section with an appropriate duration is estimated in the first half of a musical piece, but a structure section having a shorter duration than the actual structure section is estimated in the latter half of the musical piece. Given the circumstances described above, an object of this disclosure is to accurately estimate the structure sections of a musical piece.

In order to solve the problem described above, a music analysis method according to one example of the present disclosure comprises calculating an evaluation index of each of a plurality of structure candidates formed of N analysis points (where N is a natural number greater than or equal to 2 and less than K), selected in different combinations from K analysis points (where K is a natural number greater than or equal to 2) in an audio signal of a musical piece, and selecting one of the plurality of structure candidates as a boundary of a structure section of the musical piece in accordance with the evaluation index of each of the plurality of structure candidates. The calculating of the evaluation index includes executing a first analysis process by calculating, from a first feature amount of the audio signal, a first index indicating a degree of certainty that the N analysis points of each of the plurality of structure candidates correspond to the boundary of the structure section of the musical piece, for each of the plurality of structure candidates, executing a second analysis process by calculating a second index indicating a degree of certainty that each of the plurality of structure candidates corresponds to the boundary of the structure section of the musical piece in accordance with a duration of each of a plurality of candidate sections having the N analysis points of each of the plurality of structure candidates as boundaries, for each of the plurality of structure candidates, and executing an index synthesis process by calculating the evaluation index in accordance with the first index and the second index calculated for each of the plurality of structure candidates.

A music analysis device according to one example of the present disclosure comprises an electronic controller including at least one processor. The electronic controller is configured to execute a plurality of modules including an index calculation module that calculates an evaluation index for each of a plurality of structure candidates formed of N analysis points (where N is a natural number greater than or equal to 2 and less than K), selected in different combinations from K analysis points (where K is a natural number greater than or equal to 2) in an audio signal of a musical piece, and a candidate selection module that selects one of the plurality of structure candidates as a boundary of a structure section of the musical piece in accordance with the evaluation index of each of the plurality of structure candidates. The index calculation module includes a first analysis module that calculates, from a first feature amount of the audio signal, a first index indicating a degree of certainty that the N analysis points of each of the plurality of structure candidates correspond to the boundary of the structure section of the musical piece, for each of the plurality of structure candidates, a second analysis module that calculates a second index indicating a degree of certainty that each of the plurality of structure candidates corresponds to the boundary of the structure section of the musical piece in accordance with a duration of each of a plurality of candidate sections having the N analysis points of each of the plurality of structure candidates as boundaries, for each of the plurality of structure candidates, and an index synthesis module that calculates the evaluation index in accordance with the first index and the second index calculated for each of the plurality of structure candidates.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained in detail below, with reference to the drawings as appropriate. It will be apparent to those skilled in the art from this disclosure that the following descriptions of the embodiments are provided for illustration only and not for the purpose of limiting the invention as defined by the appended claims and their equivalents.

Figure 1:
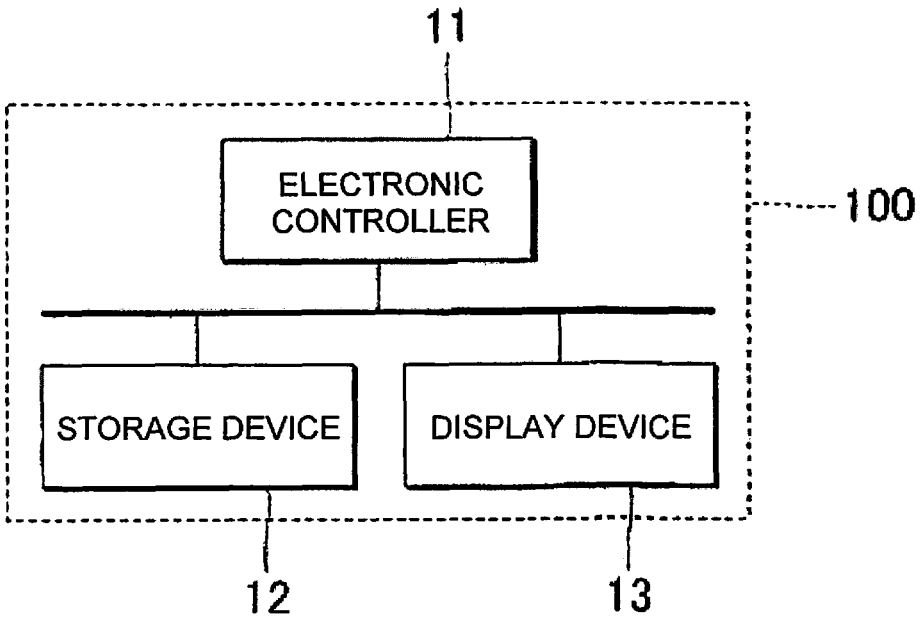
FIG. 1 is a block diagram showing a configuration of a music analysis device according to an embodiment.

FIG. 1 is a block diagram showing the configuration of a music analysis device according to one embodiment. The music analysis device 100 is an information processing device that analyzes an audio signal X representing an audio of singing sounds or the performance sounds of a musical piece in order to estimate boundaries (hereinafter referred to as "structural boundaries") of a plurality of structure sections within said musical piece. Structure sections are sections dividing a musical piece on a time axis in accordance with their musical significance or position within the musical piece. Examples of structure sections include an intro, an A-section (verse), a B-section (bridge), a chorus, and an outro. A structural boundary is the start point or the end point of each structure section.

The music analysis device 100 is realized by a computer system and comprises an electronic controller 11, a storage device (computer memory) 12, and a display device (display) 13. For example, the music analysis device 100 is realized by an information terminal such as a smartphone or a personal computer.

The electronic controller 11 is, for example, one or a plurality of processors that control each element of the music analysis device 100. The term "electronic controller" as used herein refers to hardware that executes software programs. For example, the electronic controller 11 comprises one or more types of processors, such as a CPU (Central Processing Unit), a GPU (Graphics Processing Unit), a DSP (Digital Signal Processor), an FPGA (Field Programmable Gate Array), an ASIC (Application Specific Integrated Circuit), and the like. The display device 13 displays various images under the control of the electronic controller 11. The display device 13 is, for example, a liquid-crystal display panel.

The storage device 12 is one or a plurality of memory units, each formed of a storage medium such as a magnetic storage medium or a semiconductor storage medium. A program that is executed by the electronic controller 11 (for example, a sequence of instructions to the electronic controller 11) and various data that are used by the electronic controller 11 are stored in the storage device 12, for example. For example, the storage device 12 stores the audio signal X of a musical piece to be estimated. The audio signal X is stored in the storage device 12 as a music file distributed from a distribution device to the music analysis device 100. The storage device 12 can be any computer storage device or any computer readable medium with the sole exception of a transitory, propagating signal. The storage device 12 can be formed of a combination of a plurality of types of storage media. A portable storage medium that can be attached to/detached from the music analysis device 100, or an external storage medium (for example, online storage) with which the music analysis device 100 can communicate via a communication network, can also be used as the storage device 12.

Figure 2:
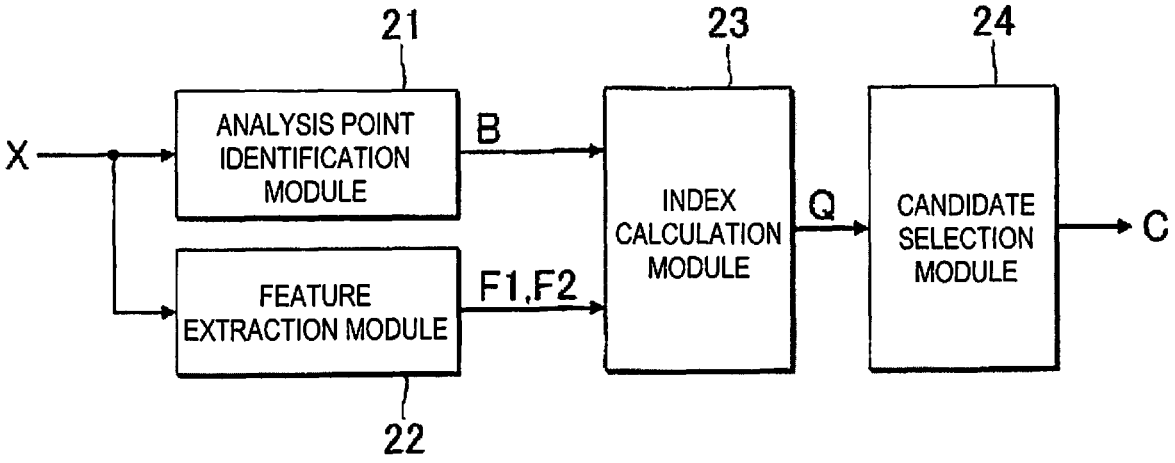
FIG. 2 is a block diagram showing a functional configuration of the music analysis device.

FIG. 2 is a block diagram showing a function that is realized by the electronic controller 11 when a program that is stored in the storage device 12 is executed. The electronic controller 11 executes a plurality of modules including an analysis point identification module 21, a feature extraction module 22, an index calculation module 23, and a candidate selection module 24 to realize the functions. Moreover, the functions of the electronic controller 11 can be realized by a plurality of devices configured separately from each other, or, some or all of the functions of the electronic controller 11 can be realized by a dedicated electronic circuit.

The analysis point identification module 21 detects K analysis points B (where K is a natural number greater than or equal to 2) in a musical piece by analyzing an audio signal X. The analysis point B is a time point that becomes a candidate for a structural boundary in the musical piece. The analysis point identification module 21 detects, as the analysis point B, a time point that is synchronous with a beat point in the musical piece, for example. For example, a plurality of beat points in the musical piece, and time points that equally divide the interval between two consecutive beat points are detected as K analysis points B. For example, the analysis points B are time points on the time axis that are at intervals corresponding to eighth notes of the musical piece. In addition, each beat point in the musical piece can be detected as the analysis point B. Moreover, time points arranged on the time axis at a cycle, obtained by multiplying the interval between two consecutive beat points in the musical piece by in integer, can be detected as the analysis points B. The plurality of beat points in the musical piece are detected by analyzing the audio signal X. Any known technique can be employed for detecting the beat points.

The feature extraction module 22 extracts a first feature amount F1 and a second feature amount F2 of the audio signal X for each of the K analysis points B. The first feature amount F1 and the second feature amount F2 are physical quantities representing features of the timbre of the sound (that is, features of the frequency characteristics such as the spectrum) represented by the audio signal X. The first feature amount F1 is, for example, MSLS (Mel-Scale Log Spectrum). The second feature amount F2 is, for example, MFCC (Mel-Frequency Cepstrum Coefficients). Frequency analysis such as the Discrete Fourier Transform is used for the extraction of the first feature amount F1 and the second feature amount F2. The first feature amount F1 is an example of a "first feature amount" and the second feature amount F2 is an example of a "second feature amount."

The index calculation module 23 calculates an evaluation index Q for each of a plurality of structure candidates C. The structure candidate C is a series of N analysis points B1 to BN (where N is a natural number greater than or equal to 2 and less than K) selected from K analysis points B in the musical piece. The combination of N analysis points B1 to BN constituting the structure candidate C is different for each structure candidate C. The number N of analysis points B that constitute the structure candidate C is also different for each structure candidate C. As can be understood from the foregoing explanation, the index calculation module 23 calculates the evaluation index Q for each of a plurality of structure candidates C formed of N analysis points B, selected in different combinations from K analysis points B.

Each structure candidate C is a candidate relating to a time series of structural boundaries in the musical piece. The evaluation index Q calculated for each structure candidate C is an index of the degree to which said structure candidate C is appropriate as a time series of structural boundaries. Specifically, the more appropriate the structure candidate C is as a time series of structural boundaries, the greater the value the evaluation index Q.

The candidate selection module 24 selects one (hereinafter referred to as "optimal candidate Ca") of a plurality of structure candidates C as the time series of structural boundaries of the musical piece, in accordance with the evaluation index Q of each structure candidate C. Specifically, the candidate selection module 24 selects, as the estimation result, the structure candidate C for which the evaluation index Q becomes the maximum, from among the plurality of structure candidates C. The display device 13 displays an image representing a plurality of structural boundaries in the musical piece estimated by the electronic controller 11.

Figure 3:
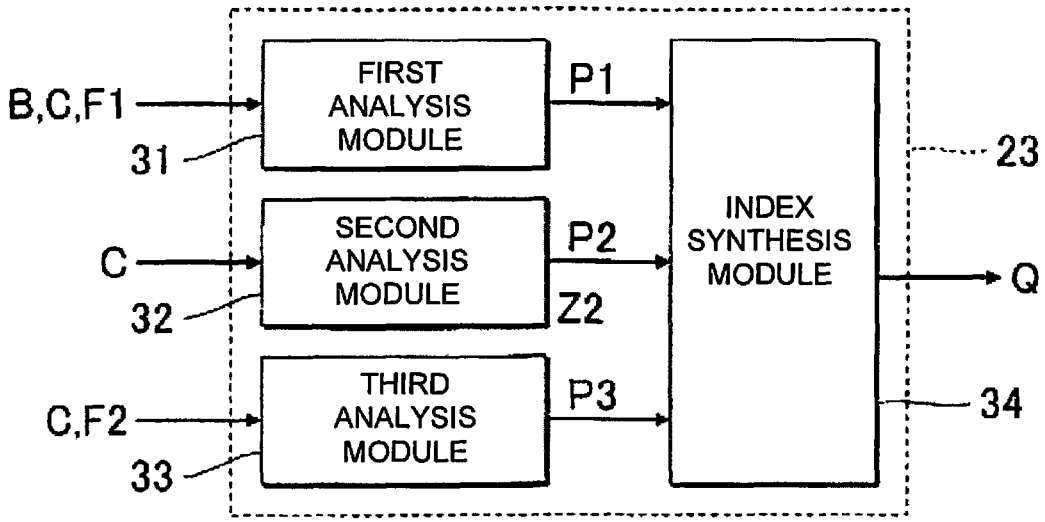
FIG. 3 is a block diagram illustrating a configuration of an index calculation module.

FIG. 3 is a block diagram illustrating a specific configuration of the index calculation module 23. The index calculation module 23 includes a first analysis module 31, a second analysis module 32, a third analysis module 33, and an index synthesis module 34.

The first analysis module 31 calculates a first index P1 for each of the plurality of structure candidates C (first analysis process). The first index P1 of each structure candidate C is an index indicating the degree of certainty (for example, the probability) that N analysis points B1 to BN of said structure candidate C correspond to the structural boundary of the musical piece. The first index P1 is calculated in accordance with the first feature amount F1 of the audio signal X. That is, the first index P1 is an index for evaluating the validity of each structure candidate C, focusing on the first feature amount F1 of the audio signal X.

Figure 4:
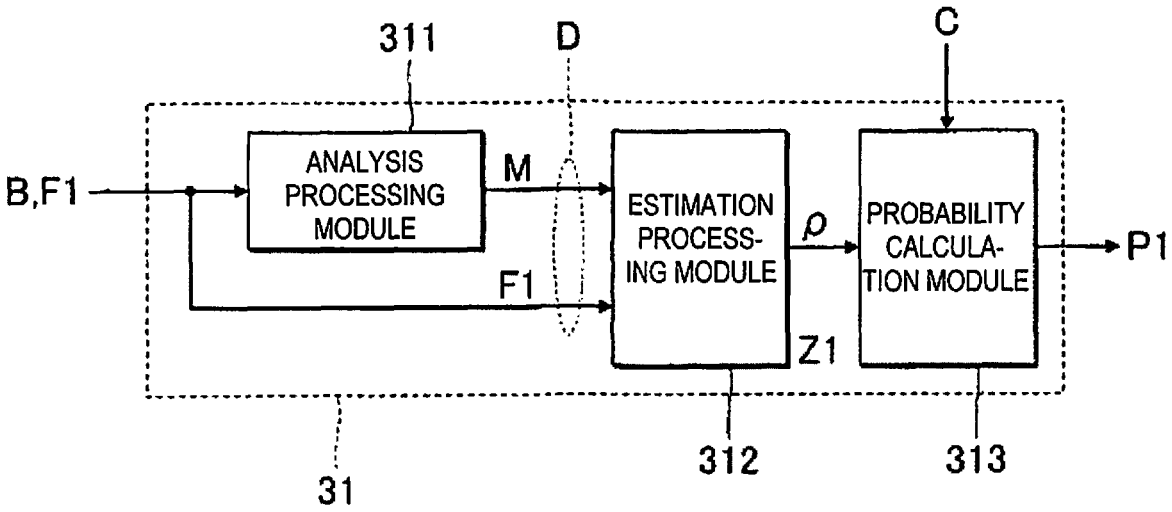
FIG. 4 is a block diagram illustrating a configuration of a first analysis module.

FIG. 4 is a block diagram showing a specific configuration of the first analysis module 31. The first analysis module 31 is provided with an analysis processing module 311, an estimation processing module 312, and a probability calculation module 313.

Figure 5:
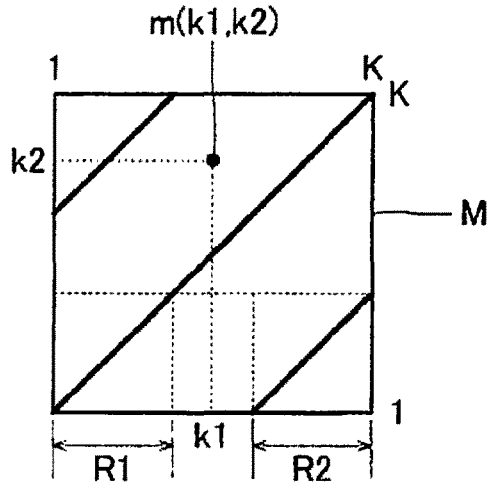
FIG. 5 is an explanatory diagram of a self-similarity matrix.

The analysis processing module 311 calculates a self-similarity matrix (SSM) M from a time series of K first feature amounts F1 respectively calculated for the K analysis points B. As shown in FIG. 5, the self-similarity matrix M is a Kth order square matrix, in which the degrees of similarity of the first feature amount F1 at two analysis points B are arranged for a time series of K first feature amounts F1. An element m (k1, k2) of row k1 column k2 (k1, k2=1–k) of the self-similarity matrix M is set to a degree of similarity (for example, inner product) between the k1th first feature amount F1 and the k2th first feature amount F1, from among the K first feature amounts F1.

In FIG. 5, the locations with a large degree of similarity in the self-similarity matrix M are represented by solid lines. In the self-similarity matrix M, the diagonal element m (k, k) of the self-similarity matrix M becomes a large numerical value, and an element m (k1, k2) along a diagonal line in a range where melodies similar or coincident with each other are repeated in the musical piece also becomes a large numerical value. For example, it is likely that similar melodies were repeated in a range R1 and a range R2, in which the diagonal element m (k1, k2) of the self-similarity matrix M is large. As can be understood from the foregoing explanation, the self-similarity matrix M is used as an index for evaluating the repetitiveness of similar melodies in a musical piece.

The estimation processing module 312 of FIG. 4 estimates a probability ρ for each of the K analysis points B in the musical piece. The probability ρ of each analysis point B is an index of the degree of certainty that the analysis point B corresponds to one structural boundary in the musical piece. Specifically, the estimation processing module 312 estimates the probability ρ of each analysis point B in accordance with the self-similarity matrix M and the time series of the first feature amount F1.

The estimation processing module 312 includes, for example, a first estimation model Z1. The first estimation model Z1, in response to input of control data D corresponding to each analysis point B, outputs the probability ρ that said analysis point B corresponds to a structural boundary. The control data D of the kth analysis point B includes a part of the self-similarity matrix M within a prescribed range that includes the kth column (or kth row), and the first feature amount F1 calculated for said analysis point B.

The first estimation model Z1 is one of various deep neural networks, such as a convolutional neural network (CNN) or a recurrent neural network (RNN). Specifically, the first estimation model Z1 is a learned model that has learned the relationship between the control data D and probability ρ, and is realized by a combination of a program that causes the electronic controller 11 to execute a computation to estimate the probability ρ from the control data D, and a plurality of coefficients that are applied to the computation. The plurality of coefficients of the first estimation model Z1 are set by machine learning that uses a plurality of pieces of teacher data including known control data D and probability ρ. Accordingly, the first estimation model Z1 outputs a statistically valid probability ρ with respect to unknown control data D, under a latent tendency existing between the probability ρ and the control data D in the plurality of pieces of teacher data.

The probability calculation module 313 of FIG. 4 calculates the first index P1 for each of the plurality of structure candidates C. The first index P1 of each structure candidate is calculated in accordance with the probability ρ estimated for each of the N analysis points B1 to BN constituting said structure candidate C. For example, the probability calculation module 313 calculates a numerical value obtained by summing the probabilities ρ for N analysis points B1 to BN as the first index P1.

With the configuration described above, the first index P1 is calculated in accordance with the probability ρ estimated by the first estimation model Z1 from the self-similarity matrix M calculated from a time series of the first feature amount F1 and the time series of the first feature amount F1. Accordingly, it is possible to select the appropriate structure candidate C, taking into account to the degree of similarity of the time series of the first feature amount F1 (that is, the repetitiveness of the melody) in each part of the musical piece.

The second analysis module 32 in FIG. 3 calculates a second index P2 for each of the plurality of structure candidates C (second analysis process). The second index P2 of each structure candidate C is an index indicating the degree of certainty that N analysis points B1 to BN of said structure candidate C correspond to the structural boundary of the musical piece. The second index P2 is calculated in accordance with the duration of each of a plurality of sections (hereinafter referred to as "candidate sections") that divide the musical piece, with the N analysis points B1 to BN of the structure candidate C as boundaries. That is, the second index P2 is an index for evaluating the validity of the structure candidate C, focusing on the duration of each of (N–1) candidate sections defined for the structure candidate C. The candidate section corresponding to a candidate for the structure candidate of the musical piece.

The second analysis module 32 includes a second estimation model Z2 for estimating the second index P2 from the N analysis points B1 to BN of the structure candidate C.

The estimation of the second index P2 by the second estimation model Z2 can be expressed by the following formula (1).

$$P2 = \prod_{n}^{N-1} p(L_n \mid L_1 \cdots L_{n-1}) \tag{1}$$

The symbol n in formula (1) indicates an infinite product. The symbol Ln in formula (1) indicates the duration of the nth candidate section and corresponds to the interval between the analysis point Bn and the analysis point Bn+1 (Ln=Bn−Bn+1). The symbol p (Ln|L1 . . . Ln−1) in formula (1) is the posterior probability that duration Ln is observed immediately after a time series of durations L1 to Ln−1 is observed. The infinite product is illustrated as an example in formula (1), but the sum of the logarithms of the probability ρ (Ln|L1 . . . Ln−1) can be estimated as the second index P2 as well. The second estimation model Z2 is, for example, a language model such as N-gram, or a recursive neural network such as long short-term memory (LSTM).

The second estimation model Z2 described above is generated by machine learning that utilizes numerous pieces of teacher data representing the duration of each structure section in existing musical pieces. That is, the second estimation model Z2 is a learned model that has learned the latent tendencies that exist in the time series of the duration of each structure section in a large number of existing musical pieces. The second estimation model Z2 learns tendencies such as there is a high probability that a structure section of 5 bars will follow a time series of a structure section of 4 bars, a structure section of 8 bars, and a structure section of 4 bars. Accordingly, based on tendencies relating to the time series of the duration of each structure section in existing musical pieces, the second index P2 will become a large numerical value regarding the structure candidate C for which the time series of the duration of each candidate section is statistically valid. That is, the greater the validity of the structure candidate C as a time series of structural boundaries of a musical piece, the greater the numerical value of the second index P2.

As described above, the second estimation model Z2, which has learned the tendencies of the duration of each structure section of musical pieces, is used. It is thus possible to select the appropriate structure candidate C based on the tendencies of the duration of each structure section in actual musical pieces.

The probability ρ (L1) relating to the candidate section between the first analysis point B1 and the immediately following analysis point B2 is determined along a prescribed probability distribution, for example. In addition, the probability ρ (LN−1|L1 . . . LN−2) relating to the candidate section between the (N−1)th analysis point BN−1 and the last analysis point BN is set to the sum of the probabilities after the last analysis point BN.

The third analysis module 33 calculates a third index P3 for each of the plurality of structure candidates C (third analysis process). The third index P3 of each structure candidate C is an index corresponding to the degree of dispersion of the second feature amount F2 in each of (N−1) candidate sections bounded by N analysis points B1 to BN of said structure candidate C. Specifically, the third analysis module 33 calculates, for each of (N−1) candidate sections, the degree of dispersion (for example, the variance) of the second feature amount F2 of each analysis point B of said candidate section, and adds a negative sign to the total value of the degree of dispersion over the (N−1) candidate sections, and thereby calculates the third index P3. Alternatively, the reciprocal of the total value of the degree of dispersion over the (N−1) candidate sections can be calculated as the third index P3.

As can be understood from the foregoing explanation, the smaller the fluctuation of the second feature amount F2 in each candidate section, the greater the numerical value of the third index P3. As described above, the second feature amount F2 is a physical quantity representing features of the timbre of the sound represented by the audio signal X. Accordingly, the third index P3 corresponds to an index of the homogeneity of the timbre in each candidate section. Specifically, the higher the homogeneity of the timbre in each candidate section, the greater the numerical value of the third index P3. The timbre tends to remain homogeneous within a single structure section of a musical piece. That is, it is unlikely that the timbre will vary excessively within a structure section. Therefore, the greater the validity of the structure candidate C as a time series of structural boundaries of a musical piece, the greater the numerical value of the third index P3. As can be understood from the foregoing explanation, the third index P3 is an index for evaluating the validity of the structure candidate C, focusing on the homogeneity of the timbre in each candidate section.

As described above, the third index P3 corresponding to the degree of dispersion of the second feature amount F2 in each candidate section is calculated, and the third index P3 is reflected in the evaluation index Q for selecting the optimal candidate Ca. It is therefore possible to select the appropriate structure candidate C based on the tendency that the timbre tends to remain homogeneous within each structure section.

The index synthesis module 34 calculates the evaluation index Q of each structure candidate C in accordance with the first index P1, the second index P2, and the third index P3. Specifically, the index synthesis module 34 is, as expressed by the following formula (2), calculates the weighted sum of the first index P1, the second index P2, and the third index P3 as the evaluation index Q. The weighted values α1 to α3 of the formula (2) are set to prescribed positive numbers. Alternatively, the index synthesis module 34 can change the weighted values α1 to α3 in accordance with the user's instruction, for example. As can be understood from formula (2), the numerical value of the evaluation index Q increases as the first index P1, the second index P2, or the third index P3 increases.

$$Q = \alpha 1 \cdot P1 + \alpha 2 \cdot P2 + \alpha 3 \cdot P3 \tag{2}$$

As described above, the candidate selection module 24 of FIG. 2 selects, as the time series of structural boundaries of the musical piece, the optimal candidate Ca for which the evaluation index Q becomes maximum, from among the plurality of structure candidates C. Specifically, the candidate selection module 24 searches for one optimal candidate Ca from among the plurality of structure candidates C by a beam search, as illustrated below.

Figure 6:
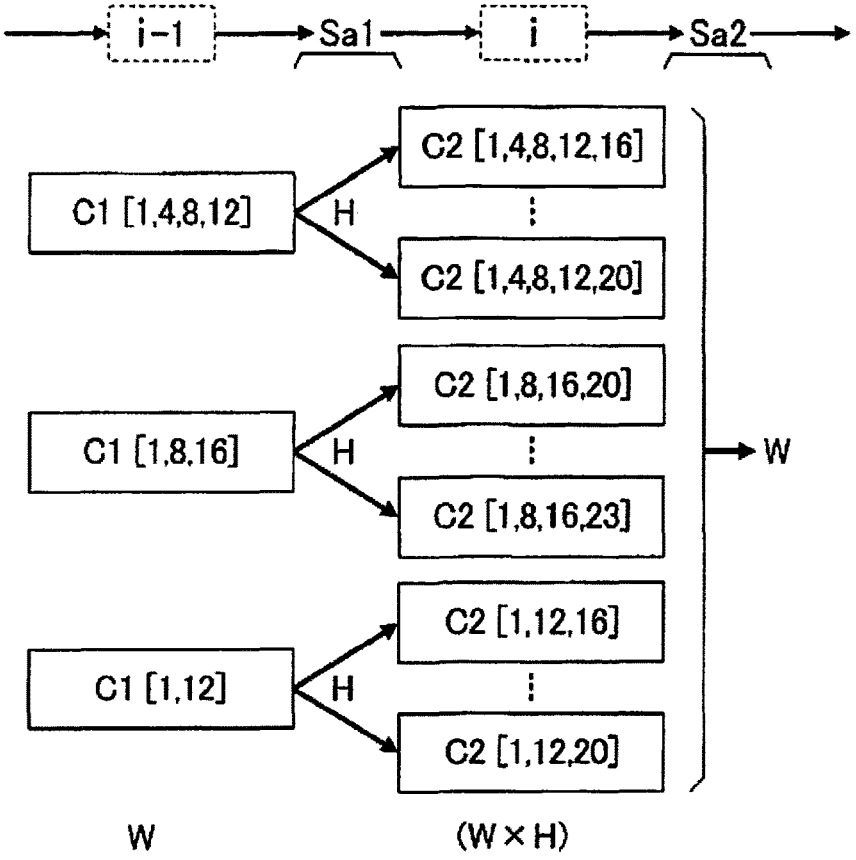
FIG. 6 is an explanatory diagram of a beam search.
Figure 7:
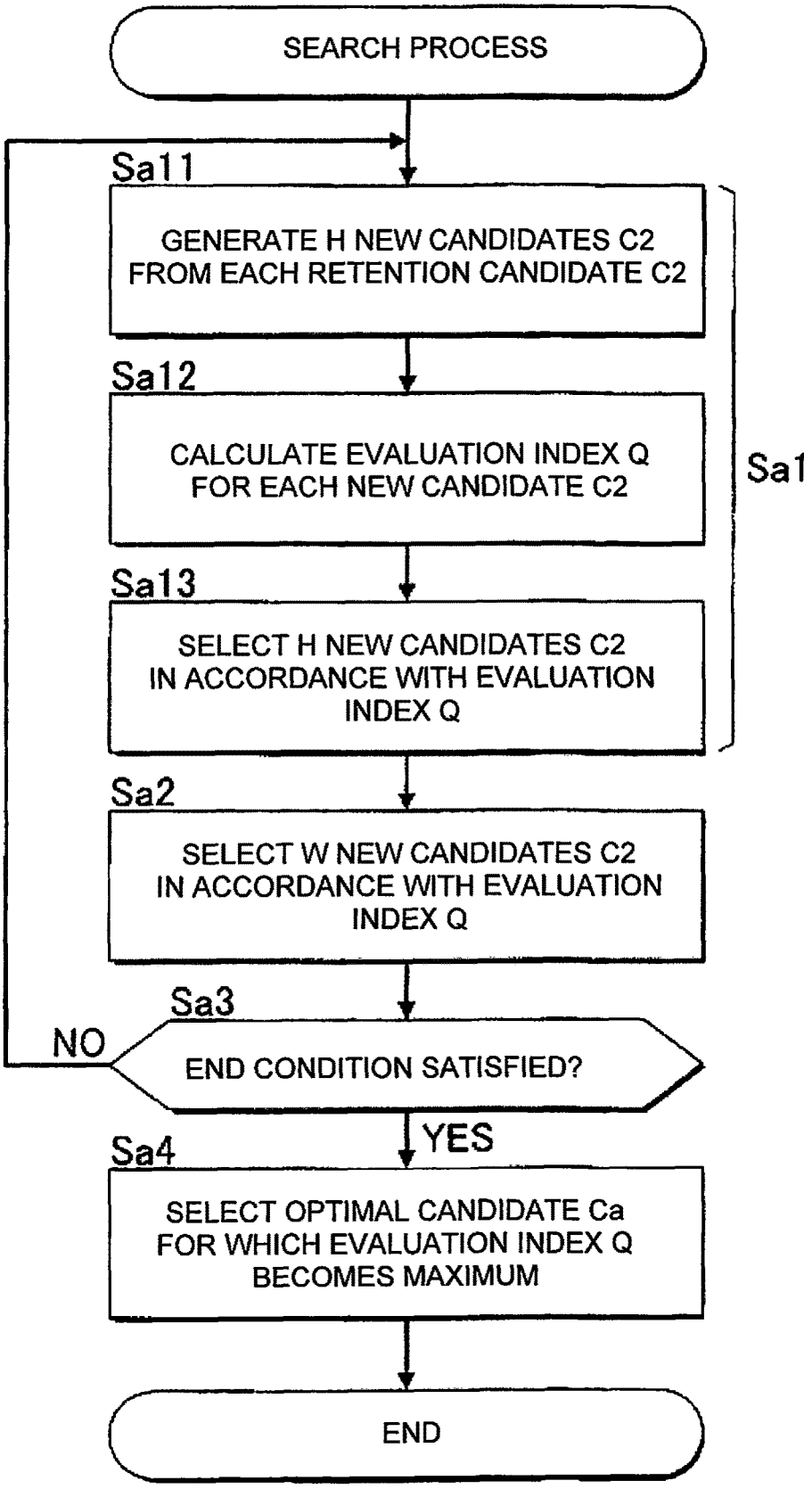
FIG. 7 is a flowchart showing a specific procedure of a search process.

FIG. 6 is an explanatory diagram of a process carried out by the candidate selection module 24 to search for the optimal candidate Ca (hereinafter referred to as "search process"), and FIG. 7 is a flowchart illustrating the specifics of the search process. As shown in FIG. 6, the search process includes a repetition of a plurality of unit processes. The ith unit process includes the following first process Sa1 and second process Sa2.

In the first process Sa1, the candidate selection module 24 generates H structure candidates C (hereinafter referred to as "new candidates C2") from each of W structure candidates C (hereinafter referred to as "retention candidates C1") selected in the second process Sa2 of the (i−1)th unit process (W and H are natural numbers).

Specifically, the candidate selection module 24 adds to J analysis points B1-BJ (J is a natural number greater than or equal to 1) of each retention candidate C1 one analysis point B positioned after said analysis point BJ, and thereby generates a new candidate C2 (Sa11). The new candidate C2 is generated for each of the plurality of analysis points B positioned after the analysis point BJ, from among the K analysis points B in the musical piece.

The index calculation module 23 calculates the evaluation index Q for each of the plurality of new candidates C2 (Sa12). The candidate selection module 24 selects, from among the plurality of new candidates C2, H new candidates C2 that are positioned higher on a list of the evaluation indices Q in descending order. As a result of the execution of processes Sa11 to Sa13 for each of W retention candidates C1, (W×H) new candidates C2 are generated.

The second process Sa2 is executed immediately after the first process Sa1 illustrated above. In the second process Sa2, the candidate selection module 24 selects, from among the (W×H) new candidates C2 generated by the first process Sa1, W new candidates C2 that are positioned higher on a list of the evaluation indices Q in descending order, as the new retention candidates C1. The number W of new candidates C2 that are selected in the second process Sa2 corresponds to the beam width.

The candidate selection module 24 repeats the first process Sa1 and the second process Sa2 described above until a prescribed end condition is satisfied (Sa3: NO). The end condition is that the analysis point B included in the structure candidate C reaches the end of the musical piece. When the end condition is satisfied (Sa3: YES), the candidate selection module 24 selects, from among the plurality of structure candidates C retained at said time point, the optimal candidate Ca for which the evaluation index Q becomes maximum (Sa4).

As described above, one of the plural structure candidates C is selected by a beam search. Thus, the processing load (for example, the number of calculations) required for selecting the optimal candidate Ca can be reduced compared to a configuration in which calculation of the evaluation index Q and selection of the optimal candidate Ca are executed, using all the combinations of selecting N analysis points B1 to BN from among K analysis points B.

Figure 8:
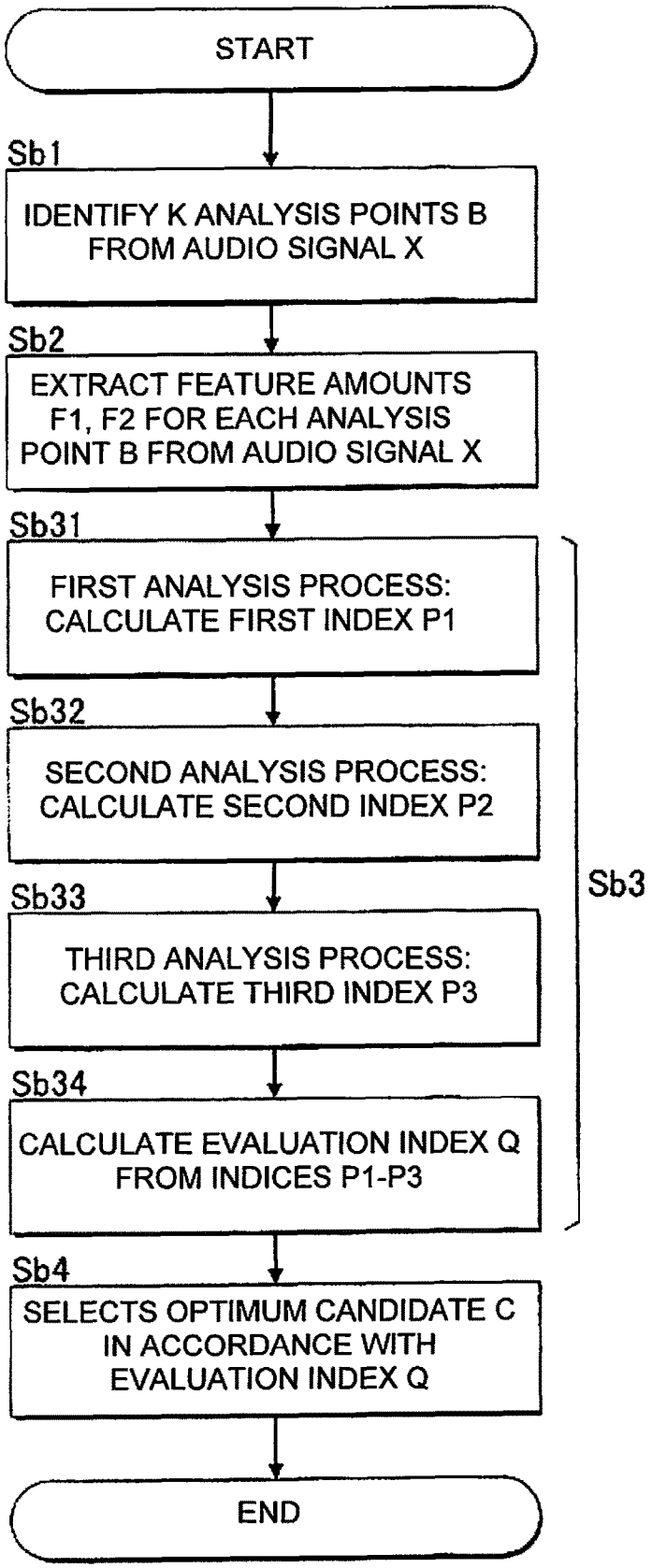
FIG. 8 is a flowchart showing a specific procedure of a music analysis process.

FIG. 8 is a flowchart showing the specific procedure of a process (hereinafter referred to as "music analysis process") by which the electronic controller 11 estimates the structural boundaries of a musical piece. For example, the music analysis process is initiated by the user's instruction to the music analysis device 100. The music analysis process is one example of the "music analysis method."

The analysis point identification module 21 detects K analysis points B in a musical piece by analyzing the audio signal X (Sb1). The feature extraction module 22 extracts the first feature amount F1 and the second feature amount F2 of the audio signal X for each of the K analysis points B (Sb2). The index calculation module 23 calculates the evaluation index Q for each of the plural structure candidates C (Sb3). The candidate selection module 24 selects one of the plural structure candidates C as the optimal candidate Ca, in accordance with the evaluation index Q of each structure candidate C (Sb4). The calculation of the evaluation index Q (Sb3) includes a first analysis process Sb31, a second analysis process Sb32, a third analysis process Sb33, and an index synthesis process Sb34.

The first analysis module 31 executes the first analysis process Sb31 for calculating the first index P1 for each structure candidate C. The second analysis module 32 executes the second analysis process Sb32 for calculating the second index P2 for each structure candidate C. The third analysis module 33 executes the third analysis process Sb33 for calculating the third index P3 for each structure candidate C. The index synthesis module 34 executes the index synthesis process Sb34 for calculating the evaluation index Q for each structure candidate C in accordance with the first index P1, the second index P2, and the third index P3. The order of the first analysis process Sb31, the second analysis process Sb32, and the third analysis process Sb33 is arbitrary.

As explained above, the second index P2 is calculated in accordance with the duration of each of the (N−1) candidate sections bounded by the N analysis points B1 to BN of the structure candidate C, and the second index P2 is reflected in the evaluation index Q for selecting any one of the plural structure candidates C. That is, the structure section of the musical piece is estimated, taking into account the validity of the duration of each structure section. Thus, compared to a configuration in which a structure section of a musical piece is estimated only from the feature amount of the audio signal X, it is possible to estimate the structure section of the musical piece with high accuracy. For example, the likelihood that the analysis results will not match within the musical piece, in terms of the duration of structure sections, is reduced.

Specific modified embodiments to be added to each of the aforementioned embodiments exemplified are illustrated below. Two or more embodiments arbitrarily selected from the following examples can be appropriately combined as long as they do not contradict each other.

(1) In the above-described embodiments, an embodiment in which the first analysis process Sb31, the second analysis process Sb32, and the third analysis process Sb33 are executed is used as example, but the first analysis process Sb31 and/or the third analysis process Sb33 can be omitted. In a configuration in which the first analysis process Sb31 is omitted, the evaluation index Q is calculated in accordance with the second index P2 and the third index P3, and in a configuration in which the third analysis process Sb33 is omitted, the evaluation index Q is calculated in accordance with the first index P1 and the second index P2. In addition, in a configuration in which the first analysis process Sb31 and the third analysis process Sb33 are omitted, the evaluation index Q is calculated in accordance with the second index P2.

(2) In the above-mentioned embodiment, time points synchronous with the beat points of the musical piece are specified as the analysis points B, but the method for specifying the K analysis points B is not limited to the example described above. For example, a plurality of analysis points B arranged on the time axis with a prescribed period can be set as well, regardless of the audio signal X.

(3) In the embodiment described above, the MSLS of the audio signal X is shown as the first feature amount F1, but the type of the first feature amount F1 is not limited to the example described above. For example, the MFCC or the envelope of the frequency spectrum can be used as the first feature quantity F1. Similarly, the second feature amount F2 is not limited to the MFCC used as an example in the above-described embodiment. For example, the MSLS or the envelope of the frequency spectrum can be used as the second feature amount F2. In addition, in the embodiment described above, a configuration in which the first feature amount F1 and the second feature amount F2 are different is shown as an example, but the first feature amount F1 and the second feature amount F2 can be of the same type. That is, one type of feature amount extracted from the audio signal X can also be used for the calculation of the self-similarity matrix M as well as the calculation of the second index P2.

(4) The music analysis device 100 can also be realized by a server device that communicates with a terminal device such as a mobile phone or a smartphone. For example, the music analysis device 100 selects the optimal candidate Ca by analysis of the audio signal X received from a terminal device, and sends the optimal candidate Ca to the requesting terminal device. In a configuration in which the analysis point identification module 21 and the feature extraction module 22 are mounted on a terminal device, the music analysis device 100 receives control data that include K analysis points B, a time series of the first feature amount F1, and a time series of the second feature amount F2 from the terminal device, and uses the control data to execute the calculation of the evaluation index Q (Sb3) and the selection of the optimal candidate Ca (Sb4). The music analysis device 100 sends the optimal candidate Ca to the requesting terminal device. As can be understood from the foregoing explanation, the analysis point identification module 21 and the feature extraction module 22 can be omitted from the music analysis device 100.

(5) As described above, the functions of the music analysis device 100 exemplified above are realized by cooperation between one or a plurality of processors that constitute the electronic controller 11, and a program stored in the storage device 12. The program according to the present disclosure can be provided in a form stored in a computer-readable storage medium and installed on a computer. The storage medium is, for example, a non-transitory storage medium, a good example of which is an optical storage medium (optical disc) such as a CD-ROM, but can include storage media of any known format, such as a semiconductor storage medium or a magnetic storage medium. Non-transitory storage media include any storage medium that excludes transitory propagating signals and does not exclude volatile storage media. In addition, in a configuration in which a distribution device distributes the program via a communication network, a storage device that stores the program in the distribution device corresponds to the non-transitory storage medium.

(6) For example, the following configurations can be understood from the embodiments exemplified above.

A music analysis method according to a first aspect of the present disclosure comprises calculating an evaluation index for each of a plurality of structure candidates formed of N analysis points (where N is a natural number greater than or equal to 2 and less than K) selected in different combinations from K analysis points (where K is a natural number greater than or equal to 2) in an audio signal of a musical piece, and selecting one of the plural structure candidates as a boundary of a structure section of the musical piece in accordance with the evaluation index of each of the structure candidates, wherein calculating the evaluation index includes a first analysis process for calculating, from a first feature amount of the audio signal, a first index indicating the degree of certainty that the N analysis points of the structure candidates correspond to a boundary of the structure section of the musical piece, for each of the plurality of structure candidates; a second analysis process for calculating a second index indicating the degree of certainty that the structure candidate corresponds to the boundary of the structure section of the musical piece in accordance with the duration of each of a plurality of candidate sections having the N analysis points of the structure candidate as boundaries, for each of the plurality of structure candidates; and an index synthesis process for calculating the evaluation index in accordance with the first index and the second index calculated for each of the plurality of structure candidates. The number N of analysis points that constitute the structure candidate can be different for each structure candidate.

By the aspect described above, the second index is calculated in accordance with the duration of each of the plurality of candidate sections bounded by the N analysis points of the structure candidate, and the second index is reflected on the evaluation index for selecting one from among the plurality of structure candidates. That is, the structure section of the musical piece is estimated, taking into account the validity of the duration of each structure section. Thus, compared to a configuration in which a structure section of a musical piece is estimated only from the feature amount relating to the timbre of the audio signal, it is possible to estimate the structure section of the musical piece with high accuracy. For example, the likelihood that the analysis results will not match within the musical piece, in terms of the duration of structure sections, is reduced.

According to a second aspect of the first aspect, calculating the evaluation index includes executing a third analysis process for calculating a third index corresponding to the degree of dispersion of a second feature amount of the audio signal in each of the plurality of candidate sections having N analysis points of structure candidate as boundaries, for each of the plurality of structure candidates, and the index synthesis process includes calculating the evaluation index in accordance with the first index, the second index, and the third index calculated for each of the plurality of structure candidates. By the aspect described above, the third index corresponding to the degree of dispersion (for example, variance) of the second feature amount in each candidate section is calculated, and the third index is reflected in the evaluation index for selecting one of the plural structure candidates. The third index is an index of the homogeneity of the timbre in a candidate section. It is therefore possible to estimate the structure section of the musical piece with high accuracy based on the tendency that the timbre will not change excessively within one structure section of a musical piece.

According to a third aspect of the first aspect or the second aspect, the first analysis process includes inputting a self-similarity matrix calculated from a time series of the first feature amount corresponding to each of the K analysis points and a time series of the first feature amount into a first estimation model and thereby calculate the first index in accordance with a probability calculated for the N analysis points, from among the probabilities calculated for each of the K analysis points. By the aspect described above, the first index is calculated in accordance with the probability estimated by the first estimation model from the self-similarity matrix calculated from a time series of the first feature amount and the time series of the first feature amount. Thus, it is possible to calculate an appropriate first index, taking into account the degree of similarity of the time series of the first feature amount (that is, the repetitiveness of the melody) in each part of the musical piece.

According to a fourth aspect of any one of the first to the third aspects, the second analysis process includes using a second estimation model which has learned tendencies of the duration of each of a plurality of structure sections of musical pieces, and thereby calculates a second index for each of the plurality of structure candidates. In the aspect described above, the second estimation model, which has learned the tendencies of the duration of each structure section of musical pieces, is used. It is therefore possible to select an appropriate second index based on the tendencies of the duration of each structure section in actual musical pieces. The second estimation model is, for example, an N-gram model or LSTM (long-short term memory).

According to a fifth aspect of any one of the first to the fourth aspects, selecting the structure candidate includes selecting one of the plural structure candidates by a beam search. By the aspect described above, one of the plural structure candidates is selected by a beam search. The processing load can therefore be reduced compared to a configuration in which calculation of the evaluation index and selection of the structural candidate are executed using all the combinations of selecting N analysis points from among K analysis points.

A music analysis device according to a sixth aspect of the present disclosure comprises an index calculation unit for calculating an evaluation index for each of a plurality of structure candidates formed of N analysis points (where N is a natural number greater than or equal to 2 and less than K) selected in different combinations from K analysis points (where K is a natural number greater than or equal to 2) in an audio signal of a musical piece, and a candidate selection module (unit) for selecting one of the plural structure candidates as a boundary of a structure section of the musical piece in accordance with the evaluation index of each of the structure candidates, wherein the index calculation module (unit) includes a first analysis module (unit) for calculating, from a first feature amount of the audio signal, a first index indicating the degree of certainty that the N analysis points of the structure candidates correspond to a boundary of the structure section of the musical piece, for each of the plurality of structure candidates; a second analysis module (unit) for calculating a second index indicating the degree of certainty that the structure candidate corresponds to the boundary of the structure section of the musical piece in accordance with the duration of each of a plurality of candidate sections having the N analysis points of the structure candidate as boundaries, for each of the plurality of structure candidates; and an index synthesis module (unit) for calculating the evaluation index in accordance with the first index and the second index calculated for each of the plurality of structure candidates.

A program according to a seventh aspect of the present disclosure is a program that causes a computer to function as an index calculation module (unit) for calculating an evaluation index for each of a plurality of structure candidates formed of N analysis points (where N is a natural number greater than or equal to 2 and less than K) selected in different combinations from K analysis points (where K is a natural number greater than or equal to 2) in an audio signal of a musical piece, and a candidate selection module (unit) for selecting one of the plural structure candidates as a boundary of a structure section of the musical piece in accordance with the evaluation index of each of the structure candidates, wherein the index calculation module (unit) includes a first analysis module (unit) for calculating, from a first feature amount of the audio signal, a first index indicating the degree of certainty that the N analysis points of the structure candidates correspond to a boundary of the structure section of the musical piece, for each of the plurality of structure candidates; a second analysis module (unit) for calculating a second index indicating the degree of certainty that the structure candidate corresponds to the boundary of the structure section of the musical piece in accordance with the duration of each of a plurality of candidate sections having the N analysis points of the structure candidate as boundaries, for each of the plurality of structure candidates; and an index synthesis module (unit) for calculating the evaluation index in accordance with the first index and the second index calculated for each of the plurality of structure candidates.

What is claimed is:

1. A music analysis method realized by a computer, the method comprising:

calculating an evaluation index of each of a plurality of structure candidates formed of N analysis points selected in different combinations from K analysis points in an audio signal of a musical piece, N being a natural number greater than or equal to 2 and less than K, and K being a natural number greater than or equal to 2; and selecting one of the plurality of structure candidates as a boundary of a structure section of the musical piece in accordance with the evaluation index of each of the plurality of structure candidates, the calculating of the evaluation index including executing a first analysis process by calculating, from a first feature amount of the audio signal, a first index indicating a degree of certainty that the N analysis points of each of the plurality of structure candidates correspond to the boundary of the structure section of the musical piece, for each of the plurality of structure candidates, executing a second analysis process by calculating a second index indicating a degree of certainty that each of the plurality of structure candidates corresponds to the boundary of the structure section of the musical piece in accordance with a duration of each of a plurality of candidate sections having the N analysis points of each of the plurality of structure candidates as boundaries, for each of the plurality of structure candidates, and executing an index synthesis process by calculating the evaluation index in accordance with the first index and the second index calculated for each of the plurality of structure candidates.

2. The music analysis method according to claim 1, wherein the calculating of the evaluation index further includes executing a third analysis process by calculating a third index corresponding to a degree of dispersion of a second feature amount of the audio signal in each of the plurality of candidate sections having the N analysis points of each of the structure candidates as boundaries, for each of the plurality of structure candidates, and the index synthesis process is executed by calculating the evaluation index in accordance with the first index, the second index, and the third index calculated for each of the plurality of structure candidates.

3. The music analysis method according to claim 1, wherein the first analysis process includes calculating the first index in accordance with a probability calculated for the N analysis points, from among probabilities calculated for each of the K analysis points, by inputting a self-similarity matrix calculated from a time series of the first feature amount corresponding to each of the K analysis points, and the time series of the first feature amount into a first estimation model.

4. The music analysis method according to claim 1, wherein the second analysis process includes calculating the second index for each of the plurality of structure candidates using a second estimation model which has learned tendencies of duration of each of a plurality of structure sections of musical pieces.

5. The music analysis method according to claim 1, wherein the selecting of one of the structure candidates is performed by selecting one of the plurality of structure candidates by a beam search.

6. A music analysis device comprising:

an electronic controller including at least one processor, the electronic controller being configured to execute a plurality of modules including an index calculation module that calculates an evaluation index of each of a plurality of structure candidates formed of N analysis points selected in different combinations from K analysis points in an audio signal of a musical piece, N being a natural number greater than or equal to 2 and less than K, and K being a natural number greater than or equal to 2, and a candidate selection module that selects one of the plurality of structure candidates as a boundary of a structure section of the musical piece in accordance with the evaluation index of each of the plurality of structure candidates, the index calculation module including a first analysis module that calculates, from a first feature amount of the audio signal, a first index indicating a degree of certainty that the N analysis points of each of the plurality of structure candidates correspond to the boundary of the structure section of the musical piece, for each of the plurality of structure candidates, a second analysis module that calculates a second index indicating a degree of certainty that each of the plurality of structure candidates corresponds to the boundary of the structure section of the musical piece in accordance with a duration of each of a plurality of candidate sections having the N analysis points of each of the plurality of structure candidates as boundaries, for each of the plurality of structure candidates, and an index synthesis module that calculates the evaluation index in accordance with the first index and the second index calculated for each of the plurality of structure candidates.

7. The music analysis device according to claim 6, wherein the index calculation module further includes a third analysis module that calculates a third index corresponding to a degree of dispersion of a second feature amount of the audio signal in each of the plurality of candidate sections having the N analysis points of each of the structure candidates as boundaries, for each of the plurality of structure candidates, and the index synthesis module calculates the evaluation index in accordance with the first index, the second index, and the third index calculated for each of the plurality of structure candidates.

8. The music analysis device according to claim 6, wherein the first analysis module calculates the first index in accordance with a probability calculated for the N analysis points, from among probabilities calculated for each of the K analysis points, by inputting a self-similarity matrix calculated from a time series of the first feature amount corresponding to each of the K analysis points, and the time series of the first feature amount into a first estimation model.

9. The music analysis device according to claim 6, wherein the second analysis module calculates the second index for each of the plurality of structure candidates using a second estimation model which has learned tendencies of duration of each of a plurality of structure sections of musical pieces.

10. The music analysis device according to claim 6, wherein the candidate selection module selects one of the plurality of structure candidates by a beam search.

11. A non-transitory computer-readable medium storing music analysis program that causes a computer to execute a process, the process comprising:

calculating an evaluation index of each of a plurality of structure candidates formed of N analysis points selected in different combinations from K analysis points in an audio signal of a musical piece, N being a natural number greater than or equal to 2 and less than K, and K being a natural number greater than or equal to 2; and selecting one of the plurality of structure candidates as a boundary of a structure section of the musical piece in accordance with the evaluation index of each of the plurality of structure candidates, the calculating the evaluation index including executing a first analysis process by calculating, from a first feature amount of the audio signal, a first index indicating a degree of certainty that the N analysis points of each of the plurality of structure candidates correspond to the boundary of the structure section of the musical piece, for each of the plurality of structure candidates, executing a second analysis process by calculating a second index indicating a degree of certainty that each of the plurality of structure candidates corresponds to the boundary of the structure section of the musical piece in accordance with a duration of each of a plurality of candidate sections having the N analysis points of each of the plurality of structure candidates as boundaries, for each of the plurality of structure candidates, and executing an index synthesis process by calculating the evaluation index in accordance with the first index and the second index calculated for each of the plurality of structure candidates.

12. The non-transitory computer-readable medium according to claim 11, wherein the calculating of the evaluation index further includes executing a third analysis process by calculating a third index corresponding to a degree of dispersion of a second feature amount of the audio signal in each of the plurality of candidate sections having the N analysis points of each of the structure candidates as boundaries, for each of the plurality of structure candidates, and the index synthesis process is executed by calculating the evaluation index in accordance with the first index, the second index, and the third index calculated for each of the plurality of structure candidates.

13. The non-transitory computer-readable medium according to claim 11, wherein the first analysis process includes calculating the first index in accordance with a probability calculated for the N analysis points, from among probabilities calculated for each of the K analysis points, by inputting a self-similarity matrix calculated from a time series of the first feature amount corresponding to each of the K analysis points, and the time series of the first feature amount into a first estimation model.

14. The non-transitory computer-readable medium according to claim 11, wherein the second analysis process includes calculating the second index for each of the plurality of structure candidates using a second estimation model which has learned tendencies of duration of each of a plurality of structure sections of musical pieces.

15. The non-transitory computer-readable medium according to claim 11, wherein the selecting of one of the structure candidates is performed by selecting one of the plurality of structure candidates by a beam search.

* * * * *